US005447050A

United States Patent [19]

Pahnke

[11] Patent Number: 5,447,050

[45] Date of Patent: Sep. 5, 1995

[54] FORMING MACHINE

[75] Inventor: Michael Pahnke, Düsseldorf, Germany

[73] Assignee: Pahnke Engineering GmbH & Co., KG, Dsseldorf, Germany

[21] Appl. No.: 128,915

[22] Filed: Sep. 30, 1993

[30] Foreign Application Priority Data

Sep. 30, 1992 [DE] Germany ..... 42 32 728.8

[51] Int. Cl.[6] ..... B21J 9/12

[52] U.S. Cl. ..... 72/453.02; 72/453.06; 72/452.08; 72/402

[58] Field of Search ..... 72/453.02, 453.03, 453.06, 72/453.08, 402

[56] References Cited

U.S. PATENT DOCUMENTS

| | | | |
|---|---|---|---|
| 3,835,682 | 9/1974 | Elger | 72/453.08 |
| 3,916,667 | 11/1975 | Paknke et al. | 72/402 |
| 4,502,307 | 3/1985 | Grunewald | 72/453.02 |

FOREIGN PATENT DOCUMENTS

| | | | |
|---|---|---|---|
| 2413150 | 8/1979 | France | 72/453.02 |
| 0202134 | 11/1984 | Japan | 72/402 |
| 0266934 | 10/1989 | Japan | 72/453.08 |
| 0529092 | 9/1976 | U.S.S.R. | 72/453.08 |
| 0708589 | 6/1986 | U.S.S.R. | 72/402 |

*Primary Examiner*—David Jones
*Attorney, Agent, or Firm*—Anderson Kill Olick & Oshinsky

[57] ABSTRACT

In a forming machine of the hydraulic press or forging machine type having at least one press cylinder acted on by a pair of values of stroke frequency and stroke volume predetermined by a first piston pump, the stroke frequency and stroke volume of the press cylinder can be adapted to the working requirements from cogging to planishing if the press cylinder has associated with it a second piston pump in parallel with the first piston pump and having a second pair of values of stroke frequency and stroke volume different from the first pair of values, and if the two piston pumps can be switched to connect them to the press cylinder simultaneously or alternatively.

8 Claims, 4 Drawing Sheets

FORMING MACHINE

TECHNICAL FIELD OF THE INVENTION

The invention relates to a forming machine, in particular a hydraulic press or hydraulic forging machine, having at least one press cylinder acted on by a pair of values of stroke frequency and stroke volume predetermined by a first piston pump.

The term "piston pump" as used herein includes single-cylinder crank- and eccentric-driven pumps and the like. The press piston, i.e. the active pressing or forging means, is movably mounted in the press cylinder.

BACKGROUND OF THE INVENTION AND PRIOR ART

In hydraulically driven presses or forging machines that can operate with so-called crank-type driving means according to German patent 36 07 737 a piston pump drives a press piston with a pressure multiplying ratio that corresponds to the ratio of the piston areas of the piston pump and the press piston, and with a sinusoidal stroke movement having an amplitude ratio inversely proportional to the cylinder areas. The stroke frequency is determined by the speed of rotation of the drive of the piston pump.

Changing the stroke (stroke volume or stroke length) of the press piston is only possible with a great deal of trouble. However, a typical forging process requires both of these changes. In rough forging or cogging long strokes are used at low frequencies in order to allow sufficient time for transport (feeding) of the forging between the working strokes. To produce the smoothest possible surface at the end of the forging process, in so-called planishing, high stroke frequencies with short strokes are required.

To solve this problem it would seem obvious to provide an adjustable eccentric or crank stroke in the piston pump or the like. The means required to do this are, however, technically so complicated and so unreliable that they have not been adopted in practice.

An alternative described in German patent 23 06 566 is to use two to three switchable stroke lengths. For each press cylinder there is a double piston in which the two piston faces can be connected separately, so that different displacement volumes lead to corresponding different lengths of stroke of the press piston. The stepped pistons needed for this purpose are technically complicated, and in addition only relatively low working frequencies can be used, since the whole mass of the double piston always has to cover the whole stroke.

A disadvantage of all the known devices is that a change in the stroke frequency can only be effected by changing the speed of the drive. Not only does this require a drive equipped with suitable change-speed means, but it also takes quite a long time to change the speed. During the changeover time the machine is not productive.

The starting point of the present invention is that in open die forging, especially bar forging, the operation is divided into two stages with different requirements. The first stage comprises the forming proper: here a large-section ingot is formed into a small-section bar, and as well as the change in shape the internal structure of the material is generally also changed. For this purpose it is necessary to perform both a long working stroke (to obtain a large depth of penetration) and a long feed between each pair of working strokes. The second stage comprises the so-called planishing, i.e. the production of an exactly sized bar that is for example straight and is as smooth as possible. For this purpose relatively short working strokes are required with only a small depth of penetration and a small amount of feed.

OBJECT OF THE INVENTION

It is an object of the invention to provide a hydraulic forming machine driven by piston pumps in which, for continuous forming of every single workpiece, starting with cogging or drawing down and ending with planishing, the stroke length and frequency can be adapted to the requirements of the respective working stage. The length of stroke, i.e. the stroke of the forming machine that is important for the result of the working, means as usual the quotient of the stroke volume and piston area.

SUMMARY OF THE INVENTION

The solution provided by the invention consists, for the above-mentioned forming machine with at least one press cylinder, in associating with the press cylinder, in parallel with the first piston pump, a second piston pump having a second pair of values of stroke frequency and volume that differs from the first pair of values, and in providing for the two piston pumps to be switched to connect them alternatively or simultaneously to the press cylinder, in particular through a valve system with two valves.

The invention provides a drive for a hydraulic press or forging machine in which both the stroke length and the stroke frequency of the press cylinder can be changed in a technically simple manner, reliably and without loss of time, by separate operation or by superposition of sine curves resulting from the pumping movements of the two piston pumps. Thus the invention is not concerned with changing the position of the stroke, i.e. the extent of forging, for example to obtain a rapid opening and closing movement of the press in individual strokes, with adequate time and space for handling before the next stroke, but with the ability to change over quickly and in a technically simple manner from one pair of stroke frequencies and lengths to another pair of values of frequency and stroke length.

The two piston pumps that can, according to the invention, be connected to the press cylinder either alternatively or simultaneously, and which according to the invention have different pairs of values of stroke frequency and length or volume, are each connected to the press cylinder by a respective switching valve. When used alternatively (i.e. valve switching) they deliver to the forming machine either the one or the other pair of values of stroke frequency and length, or, when both piston pumps act simultaneously on the press cylinder, superposed values of stroke frequency and length and consequently a third pair of values of stroke frequency and length.

Changes in the position of the stroke and thus of the extent of forging can be obtained by feeding or removal of pressure medium into or from the connecting line between pumps and press cylinder.

In accordance with the invention, the speeds and pump volumes of the two pumps are different, and their ratio to one another is preferably of the order of 1:1.5 to 1:3. A ratio of 1:2 is preferred, at which the speed (stroke frequency, 2 w) of the smaller pump is twice as great and its displacement (stroke volume or length, $\frac{1}{2}$ a)

is half as great as the corresponding values (w, a) of the other pump.

If in this case the two piston pumps are acted on without phase shift, preferably by the same drive (motor), a summation curve F(t) is obtained having an amplitude A greater than the greater amplitude a of the two individual pairs of values, and a stroke frequency equal to the stroke frequency w of the pump curve with the greater amplitude.

The superposition of the two sine curves—a sin wt and $\frac{1}{2}$ a sin 2 wt—of stroke frequency w and stroke length a gives a summation curve $$F(T)=a \sin wt+\tfrac{1}{2} a \sin 2 wt$$

$$=a \sin wt\,(1+\cos wt),$$

where t as the variable of time, for a harmonic motion of the press piston operating in the press cylinder. This summation curve F(t) has two properties that are very advantageous for the typical forging process: in the flank between a maximum and a subsequent minimum it has a point of inflexion with a horizontal tangent, and in the next following flank a steep upward gradient between minimum and maximum.

Thus if, within the scope of the invention, the two pumps are synchronised with one another substantially without any phase shift, e.g. by a mechanical gearbox, an electrical wave or the like, it is a surprising advantage of the summation curve F(t) described that, particularly through suitable optimisation of the frequency ratio of the two piston pumps, the press piston of the forming machine can be placed on the workpiece with its motion braked to zero—namely at the point of inflexion with an at least approximately horizontal tangent—and then perform the pressing or forging work with an accelerated movement. In this way heavy blows of the press piston on the workpiece can be avoided and corresponding damage to the workpiece or machine and shocks to the building excluded. The reduction in noise that results from the gentle setting down of the tool on the workpiece is of particular advantage.

Conversely, because of the steepness of the flank of the summation curve F(t) following the flank containing the braking, the press piston is raised very quickly from the workpiece, so that the lifting time is shorter than the sum of the approach time and the forging or pressing time proper.

If the movements of the two piston pumps are not synchronous or in phase, but are performed with a phase shift, further or other advantages can be obtained within the scope of the invention. The phase shift is preferably selected such that the summation curve of stroke frequency and stroke length obtained when the press cylinder is acted on by both the piston pumps falls or rises steeply as it passes through zero in moving between maximum and minimum and vice versa, and at the maximum has a kind of plateau with a greatly shortened intermediate stroke and at the minimum there is a particularly long working stroke. In particular the phase shift in this case can be about 45°.

The working movement of the press piston in the case of phase shift of the piston pumps is advantageous for heavy cogging processes, since the working stroke and the return take place very quickly and each return is followed by a long pause for feeding the workpiece being forged. The intermediate stroke in the plateau-like maximum contributes to a harmonic motion. Instead of a stop with a pause at standstill or an unnecessarily long return overstroke the wave in the plateau at the maximum ensures an adequate feed time.

BRIEF DESCRIPTION OF THE DRAWINGS

The invention will now be explained in more detail with reference to the diagrammatic drawings of exemplary embodiments, in which.

DETAILED DESCRIPTION OF PREFERRED EMBODIMENTS OF THE INVENTION

Figure 1:
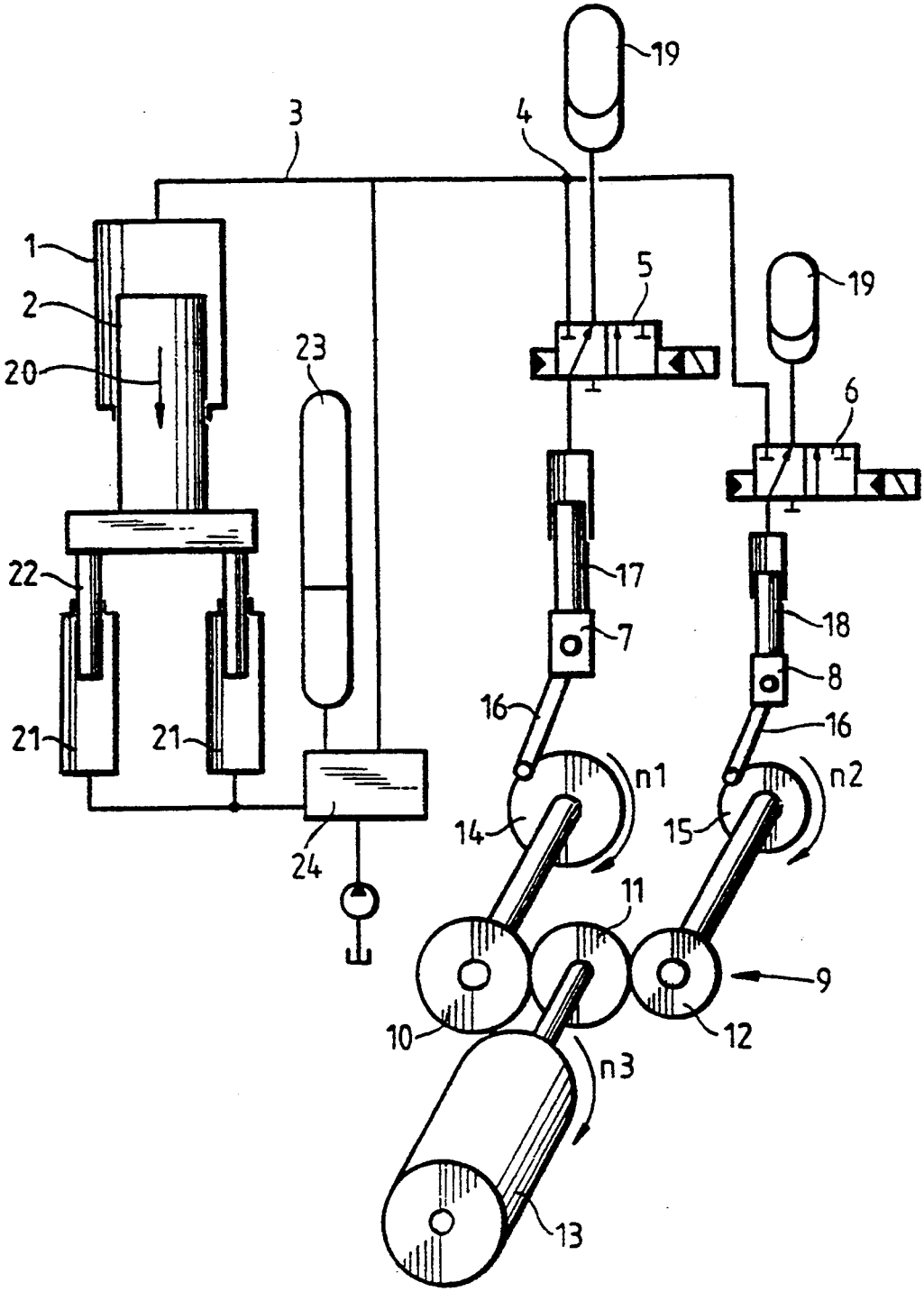
FIG. 1 shows in principle the design of a press cylinder drive according to the invention.

FIG. 1 shows in principle the design of a drive system according to the invention. A press cylinder 1 of a hydraulic forging press or a hydraulic forging machine with a press piston 2 is connected by a line 3 with a branch 4 and by respective switching valves 5 and 6 to piston pumps 7 and 8 (crank or eccentric drive pumps). The differently sized piston pumps 7 and 8 are driven via a power dividing gearbox 9 with gear wheels 10, 11 and 12 by a motor 13. The output gear wheel 11 of the motor 13 drives—constantly in the case of normal working—the input gear wheels 10 and 12 of the cranks or eccentrics 14 and 15 with connecting rods 16, and thereby the pistons 17 and 18 belonging to the piston pumps 7 and 8.

In operation the motor 13 and hence the pumps 7 and 8 should run continuously. So long as the switching valves 5 and 6 remain in the base position shown, the pumps are connected to their reservoirs 19, so that they idle and the press piston 2 remains in its rest position. If now one of the switching valves 5 or 6 is moved to its respective other position and thereby the corresponding pump 7 or 8 is connected to the press cylinder 1 via the line 3, the press piston 2 is moved in the press cylinder 1 synchronously with the respective pump piston 17 or 18 at the same frequency and with a constant stroke that is determined by the stroke of the pump piston and the ratio of the areas of the respective pump piston 17 or 18 and the press piston 2. The press piston 2, like the respective pump piston 17, 18, is moved sinusoidally.

Alternatively both switching valves 5 and 6 can be set so that both the pistons 7 and 8 act on the press cylinder 1 simultaneously via the line 3. In this case the sinusoidal working movements of the two pump pistons 17 and 18 are superposed, so that the press piston 2 performs movements corresponding to one of the resulting summation curves.

In the exemplary embodiment the piston pumps 7 and 8 are only responsible for advancing the press piston 2 in the direction 20. For the return of the press piston 2 return cylinders 21 with return pistons 22 can be provided. The restoring force for the press piston against the direction of advance 20 is then applied by the return cylinders 21 together with an accumulator 23. A hydraulic system 24 can at the same time look after the necessary safety and supply arrangements and the change in position of the press piston 2.

With this basic design of a forming machine according to the invention two operating variants are possible.

VARIANT 1

Basically, only one of the two piston pumps 7, 8 is connected to the press cylinder 1. The two driving speeds n1, n2 of the piston pumps 7, 8 or the ratio n1/n2 of the two speeds, and thus the stroke frequencies of the press piston 2, can be set at any desired values. Likewise the stroke length of the press piston 2 can be predetermined at will by way of the stroke lengths and piston diameters of the two piston pumps 7, 8.

If the switching valve 5 of the piston pump 7 (assumed to be the larger one) with the lower speed n1 is switched into the working position, the press piston 2 is moved with a long stroke and low frequency. This manner of working is ideal for cogging or drawing down of forgings, in which large reductions and long feeds are employed. For forging with short stroke and high frequency, i.e. for example for smoothing of the forging, at any time within the cycle the switching valve 5 can be moved into the base position and at the same time the switching valve 6 be moved into the working position, thereby connecting the piston pump 8 (assumed to be the smaller one) with the higher speed n2 to the press cylinder 1.

To draw down a further section of the forging, the press can be switched back again to the piston pump 7, likewise during part of a stroke.

VARIANT 2

The two piston pumps 7 and 8 are connected to the press cylinder 1 either individually or both together, as desired. In the latter case the two volume flows of the two piston pumps 7, 8 are superposed. The working movement of the press piston 2 is given by the superposition of the two sine curves resulting from the movements of the piston pumps. Corresponding dependencies for the drive speeds and the displacement volumes of the two piston pumps 7, 8 are thereby obtained. For practical use particular frequency ratios and a particular range of stroke length ratios are preferred for the production of harmonic working movements of the press piston 2.

Figure 2:
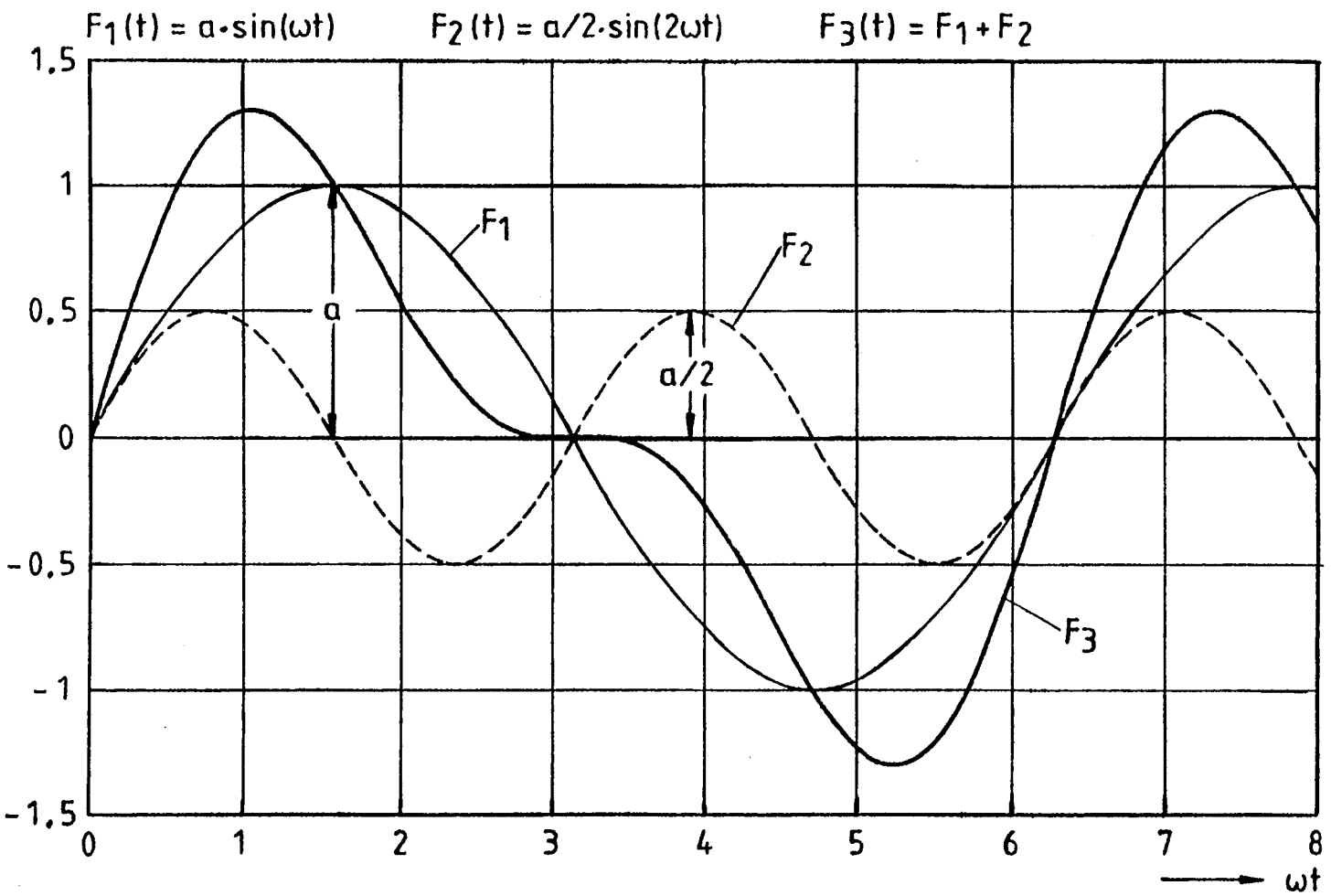
FIG. 2 shows the working movements of the piston pumps and the summation curve of the working movements when in phase.

FIG. 2 shows as an example the superposition of the working movements of the two piston pumps 7, 8:

$$F1\ (t)=a_1 \sin w_1 t \text{ and}$$

$$F2\ (t)=a_2 \sin w_2 t \text{ as}$$

$$F3\ (t)=F1+F2$$

For the case in which $a_1=2a_2=a$ and $w_1=\frac{1}{2}\ w_2=w$, the resultant, i.e. the summation curve F3, is expressed by $$F3\ (t)=a \sin w\ t\ (1+\cos w\ t).$$

The resultant F3 has, as shown in FIG. 2, a stroke $a_3$ which is greater than $a_1$ and $a_2$ and—as also appears from the formula F3 (t)—a frequency that is the same as the frequency of the curve F1. In this way one thus obtains, using the two piston pumps 7, 8, three different stroke movements with three different stroke lengths and two different stroke frequencies.

The summation curve F3 gives a harmonic motion of the press piston 2 with two very advantageous properties for the typical forging process. First, with optimised frequency tuning the point at which the forging tool meets the workpiece can be brought right into the vicinity of the horizontal tangent, i.e. of the center line (zero line) shown in the curve of FIG. 2. There the speed of the press piston 2, and consequently that of the tool, is close to zero, which very markedly lowers the often considerable level of noise and shock. Second, the curve F3 (working curve) shows that the return movement of the press piston 2 takes place considerably more quickly than its lowering and working movement. This gives sufficient time for the feed movement between two strokes, since the workpiece is quickly freed but only slowly approached again.

Figure 3:
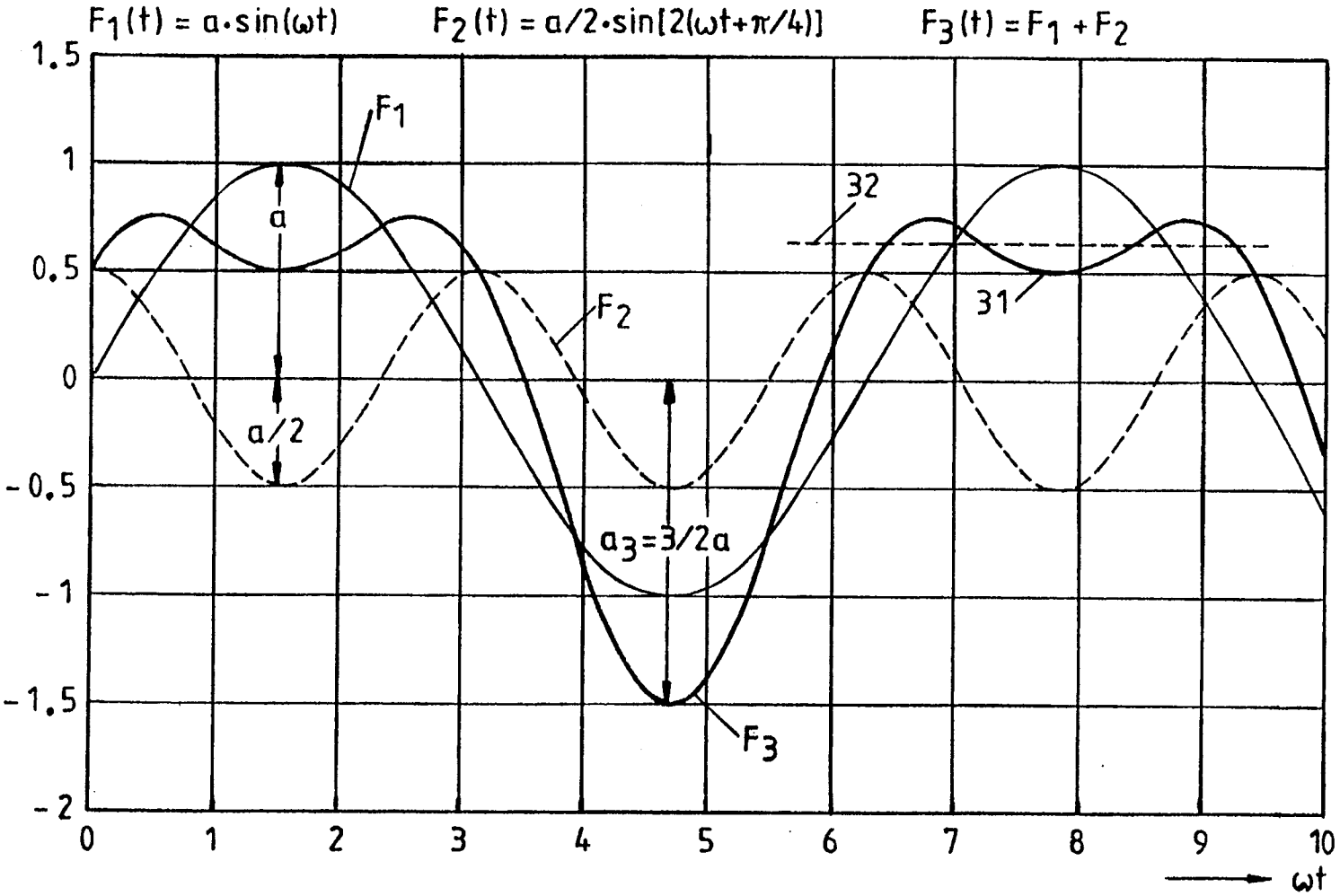
FIG. 3 is similar to FIG. 2, but with a 45° phase shift between the working movements of the piston pumps.

FIG. 3 shows the superposition of the same working movements F1 and F2 as in FIG. 2, but with a phase shift of 45°. Here, too, one obtains three different stroke movements with three different stroke lengths, the working stroke of the summation curve F3 (curve minimum) again being the greatest. This working movement is advantageous for heavy cogging processes, since the working stroke and the return take place very quickly on the steep flanks of the curve between the extreme values, with a long pause in between for feeding the workpiece. The wave 23 in the plateau-like maximum 24 of the curve F3 shown in FIG. 3 is —as mentioned above—not harmful but advantageous.

Figure 4:
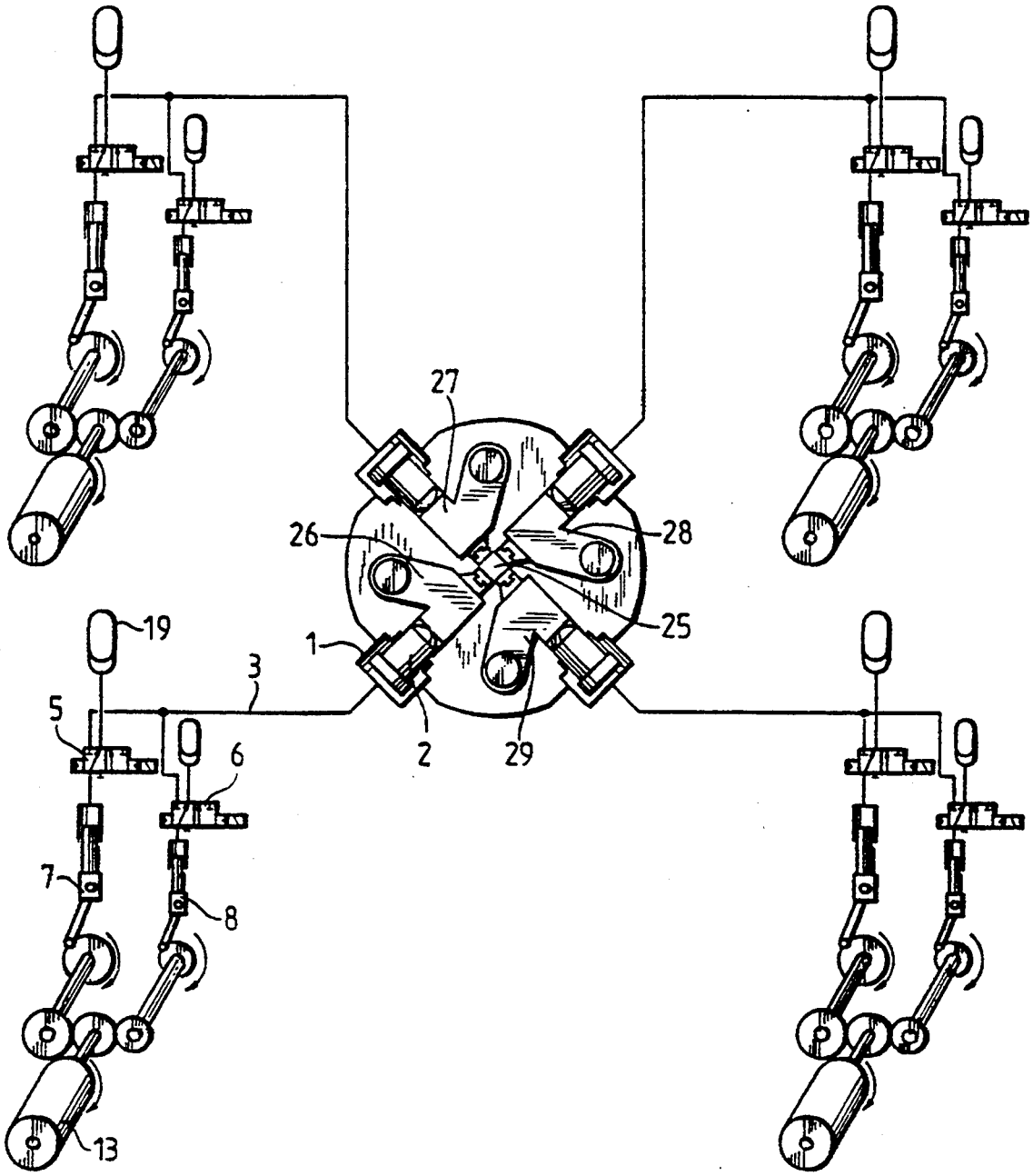
FIG. 4 shows the design of a four-hammer forging machine having a drive according to the invention.

FIG. 4 shows the drive of the working press cylinder of a hydraulically driven forging machine or the like with four working cylinders 1 arranged as a star and each driven by two piston pumps 7, 8 by way of pipelines 3 and switching valves 5, 6. The drives associated with each working or press cylinder 1 may correspond to the embodiment shown in FIG. 1. The same parts are therefore indicted in the same way as in that Figure.

As shown in FIG. 4, forging saddles 26 to 29 that face one another in pairs act in pairs or simultaneously on the forging or workpiece 25. For simplicity the return means are not shown in FIG. 4. Each press piston 2 driven in the press cylinder 1 acts on one of the forging saddles 26 to 29 such that the workpiece 25 is forged down in the desired manner and can also be smoothed in the course of the forging process.

What is claimed is:

1. A hydraulic forming machine, comprising:

at least one press cylinder arranged to be acted upon by fluid from a first pump, which pump has a first stroke frequency and a first stroke volume, wherein the press cylinder has associated with it a second piston pump in parallel with the first piston pump and having second stroke frequency and second stroke volume different from the first stroke frequency and first stroke volume, and wherein the first and second piston pumps can be switched to connect them alternatively or simultaneously to the press cylinder.

2. A hydraulic forming machine according to claim 1, wherein a valve system with two valves is arranged to enable the piston pumps to be connected to the press cylinder.

3. A hydraulic forming machine according to claim 1, wherein the piston pumps have a common permanent drive and each piston pump can be switched by means of its valve either to drive the press cylinder or to idle.

4. A hydraulic forming machine according to claim 1, wherein the stroke frequency of the one pump is twice as high and its stroke length half as great as in the corresponding pair of values of the other pump.

5. A hydraulic forming machine according to claim 1, wherein the hydraulic forming machine is a hydraulic press.

6. A process of using a hydraulic forming machine utilizing a hydraulic forming machine comprising at least one press cylinder arranged to be acted upon by fluid from a first pump, which pump has a first stroke frequency and a first stroke volume, wherein the press cylinder has associated with it a second piston pump in parallel with the first piston pump and having a second stroke frequency and a second stroke volume different from the first stroke frequency and first stroke volume, and wherein the first and second piston pumps can be switched to connect them alternatively or simultaneously to the press cylinder, wherein the process comprises:

selecting the first and second stroke frequencies of the first and second piston pumps such that a summation curve of the first and second stroke frequencies and first and second stroke lengths has on one flank of the summation curve a point of inflection with an at least substantially horizontal tangent at the point where the press piston meets the workpiece.

7. A hydraulic forming machine utilizing a hydraulic forming machine comprising at least one press cylinder arranged to be acted upon by fluid from a first pump, which pump has a first stroke frequency and a first stroke volume, wherein the press cylinder has associated with it a second piston pump in parallel with the first piston pump and having a second stroke frequency and a second stroke volume different from the first stroke frequency and first stroke volume, and wherein the first and second piston pumps can be switched to connect them alternatively or simultaneously to the press cylinder, wherein the process comprises:

shifting the movements of the first and second piston pumps in phase relative to one another such that a summation curve of stroke frequency and stroke length resulting when the press cylinder is acted on by the first and second piston pumps falls and rises steeply as the summation curve passes through zero respectively between its maximum and minimum and vice versa, and the summation curve also has at a return stroke a maximum that is plateau-like with a greatly shortened intermediate stroke.

8. A forming machine according to claim 7, wherein the phase shift amounts to approximately 45°.

* * * * *